US011823537B2

(12) United States Patent
Shikoda et al.

(10) Patent No.: US 11,823,537 B2
(45) Date of Patent: Nov. 21, 2023

(54) INFORMATION PROCESSING APPARATUS AND INFORMATION PROCESSING METHOD

(71) Applicant: Nissan Motor Co., Ltd., Kanagawa (JP)

(72) Inventors: Yu Shikoda, Kanagawa (JP); Hirofumi Inoue, Kanagawa (JP); Takehito Teraguchi, Kanagawa (JP); Jo Nishiyama, Kanagawa (JP); Shota Okubo, Kanagawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 17/767,339

(22) PCT Filed: Oct. 10, 2019

(86) PCT No.: PCT/IB2019/001228

§ 371 (c)(1),
(2) Date: Apr. 7, 2022

(87) PCT Pub. No.: WO2021/069950

PCT Pub. Date: Apr. 15, 2021

(65) Prior Publication Data

US 2023/0029272 A1 Jan. 26, 2023

(51) Int. Cl.

| | |
|---|---|
| ***G08B 13/14*** | (2006.01) |
| ***G08B 15/00*** | (2006.01) |
| ***G08B 21/24*** | (2006.01) |

(52) U.S. Cl.
CPC ..... *G08B 13/1418* (2013.01); *G08B 15/007* (2013.01); *G08B 21/24* (2013.01)

(58) Field of Classification Search
CPC ... G08B 13/1418; G08B 15/007; G08B 21/24
See application file for complete search history.

(56) References Cited

U.S. PATENT DOCUMENTS

| | | | | |
|---|---|---|---|---|
| 9,084,090 | B1 * | 7/2015 | Clement | B60W 50/08 |
| 10,640,082 | B1 * | 5/2020 | Shannon | B60R 22/48 |
| 2015/0262458 | A1 * | 9/2015 | Faaborg | H04M 19/04 340/539.11 |

(Continued)

FOREIGN PATENT DOCUMENTS

| | | | |
|---|---|---|---|
| JP | 2010-086215 | A | 4/2010 |
| JP | 2010-195229 | A | 9/2010 |
| JP | 2012-052407 | A | 3/2012 |

(Continued)

*Primary Examiner* — Brian Wilson
(74) *Attorney, Agent, or Firm* — Osha Bergman Watanabe & Burton LLP

(57) ABSTRACT

An information processing apparatus includes a getting-off determining unit that determines whether or not an occupant gets off a vehicle, a location determining unit that determines whether or not an electronic device to be used by the occupant in the vehicle is at a predetermined position in the vehicle, and a notification control unit that gives a predetermined notification to the occupant when the getting-off determining unit determines that the occupant gets off and the location determining unit determines that the electronic device is not at the predetermined position.

12 Claims, 3 Drawing Sheets

(56) References Cited

U.S. PATENT DOCUMENTS

| | | | |
|---|---|---|---|
| 2018/0285635 | A1 | 10/2018 | Arata et al. |
| 2020/0384948 | A1 | 12/2020 | Toyooka et al. |

FOREIGN PATENT DOCUMENTS

| | | | |
|---|---|---|---|
| JP | 2016-161440 | A | 9/2016 |
| JP | 2018-022392 | A | 2/2018 |
| JP | 6320647 | B1 | 4/2018 |
| JP | 2018-173756 | A | 11/2018 |

* cited by examiner

INFORMATION PROCESSING APPARATUS AND INFORMATION PROCESSING METHOD

TECHNICAL FIELD

The present invention relates to an information processing apparatus and an information processing method.

BACKGROUND ART

Conventionally, electronic devices that suppress the theft of a portable device have been provided. For example, JP2010-86215A discloses an electronic device including a car navigation device, which is a portable device, and a cradle, which has a security device and can be electrically connected to the car navigation device. This electronic device is configured to issue an alarm from the cradle once it is detected that the car navigation device has been removed from the cradle when the security device is in the ON state (vigilant state).

SUMMARY OF INVENTION

By the way, there has been considered a service that lends a portable device such as a wearable device or a mobile device to an occupant, cooperates with an in-vehicle device via the portable device, and provides guidance information according to location and situation to the occupant in a passenger compartment of a vehicle for service such as car sharing or robot taxi. When providing such a service, since the portable device is used while being worn by the occupant, there is a concern that the device may be lost due to forgetting to return or stolen.

Regarding such a concern, the technique disclosed in JP2010-86215A has not considered that the portable device is used in a state of having been removed from the cradle, that is, the portable device is used in a state of having been taken out from the predetermined position in the passenger compartment, and therefore, the technique cannot be applied to the above service which assumes that the portable device is lent to the occupant.

The objective of the present invention is to provide a technique for preventing an electronic device lent to an occupant in a passenger compartment of a vehicle for service from being lost due to forgetting to return or stolen.

An information processing apparatus according to one aspect of the present invention is including a getting-off determining unit that determines whether or not an occupant gets off a vehicle, a location determining unit that determines whether or not an electronic device to be used by the occupant in the vehicle is at a predetermined position in the vehicle, and a notification control unit that gives a predetermined notification to the occupant when the getting-off determining unit determines that the occupant gets off and the location determining unit determines that the electronic device is not at the predetermined position.

Embodiments of the present invention will be described in detail below with attached figures.

DESCRIPTION OF EMBODIMENTS

First Embodiment

Figure 1:
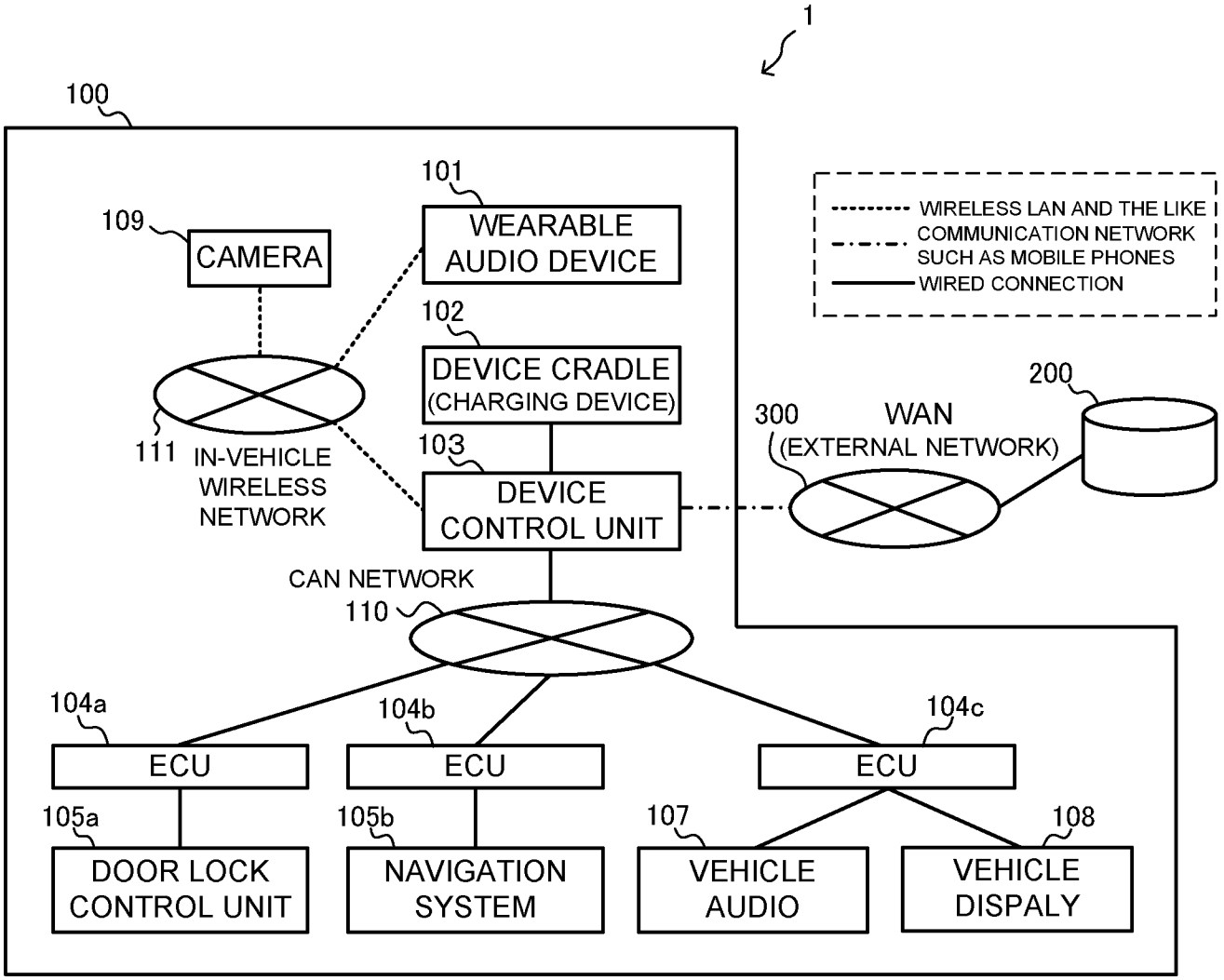
FIG. 1 is a block diagram illustrating a configuration example of an information processing system according to a first embodiment.

FIG. 1 is a block diagram illustrating a configuration example of an information processing system 1 to which an information processing apparatus (control unit 103) according to one embodiment of the present invention is applied. The information processing system 1 to which this embodiment is applied is configured as a system that provides a travel guide service to a user (occupant) in the passenger compartment of a vehicle for service, such as car sharing or robot taxi. This travel guide service is, for example, a service of lending a wearable audio device (earphone) to users who use robot taxi and providing tourist information according to location or situation to an occupant via the wearable device when the robot taxi is moving toward its destination.

The illustrated information processing system 1 is configured by connecting a vehicle 100 and a server 200 so that they can communicate information via an external network 300. The vehicle 100 mainly includes a wearable audio device 101, a device cradle 102, a device control unit 103, ECUs 104*a*, 104*b*, 104*c*, a door lock control unit 105*a*, a navigation system 105*b*, a vehicle audio 107, a vehicle display 108, and a camera 109. Hereinafter, each configuration will be described in detail.

The vehicle 100 carries out the travel guide service mentioned above. The vehicle 100 can travel manned or unmanned, carries one or a plurality of users who use the above service, and travels to a predetermined destination. As a specific example of the vehicle 100, a so-called mobility service vehicle such as robot taxi or car sharing is assumed. In this embodiment, assuming the vehicle 100 is an unmanned robot taxi, the following description continues.

The wearable audio device 101 (hereinafter also simply referred to as device 101) functions as an information providing means (notifying means) for providing tourist information to occupants via audio in the travel guide service mentioned above. More specifically, the device 101 is connected to the device control unit 103 via an in-vehicle wireless network 111 using wireless LAN and the like, and is configured to provide tourist information, etc. to occupants by audio according to the control signal from the device control unit 103. Further, tourist information is an example, and information is not limited to this. The device control unit 103 may be configured to send a navigation audio signal output from the navigation system 105*b* to the wearable audio device and output it from a loudspeaker provided in the wearable audio device. Further, the device 101 of this embodiment is a smart device integrated with a microphone similar to an earphone, and is configured to be worn on both ears or one ear of an occupant. Further, in addition to the microphone and loudspeaker, the device 101 may include a motion sensor, etc. that can constantly detect physical information such as the orientation of face, posture, and movement information of the occupant wearing the device 101 on ear. Further, the device 101 may be configured to enable individual authentication of the occupant wearing the device 101 on ear by a so-called otoacoustic authentication technique. The aforementioned device 101 is not limited to a wearable audio device such as an earphone, and may be any wearable device worn by the occupant, such as a glasses-type wearable audio device or a wearable display device for displaying an image. Furthermore, the embodiment may be configured to provide not only a wearable device but also a mobile device such as a smart phone. That is, if it is a portable device such as a wearable device or a mobile device, the occupant may take it out of the vehicle, and thus, the present invention can be applied.

The cradle 102 functions as a charging device for charging the wearable audio device 101. The cradle 102 of this embodiment is arranged at a predetermined position in the passenger compartment of the vehicle 100, and is configured to be electrically connectable to the device 101. The cradle 102 charges the device 101 in the state that the device 101 has been arranged (electrically connected) on the cradle 102. In addition, the cradle 102 has a function of determining whether the device 101 is arranged and whether the cradle 102 is electrically connected to the device 101, and is configured so that information about whether the device 101 is arranged and whether it is electrically connected can be output to the device control unit 103.

The device control unit 103 is a configuration corresponding to the information processing apparatus according to this embodiment, for example, a controller composed of a central processing unit (CPU), a read-only memory (ROM), a random-access memory (RAM), an input/output interface (I/O interface), etc. The device control unit 103 is connected to the device 101 via an in-vehicle wireless network 111 so that it can communicate information with the device 101. In addition, the device control unit 103 controls the door lock control unit 105*a*, the vehicle audio 107, and the vehicle display 108 via the CAN network 110 and the ECUs (Electric Control Units) 104*a*, 104*b*, 104*c*, respectively, and acquires the information necessary for the vehicle 100 to travel, such as the present position of the vehicle 100 and the route to the destination, from the navigation system 105*b*.

Further, the door lock control unit 105*a* is configured to control the locking/unlocking of the door lock of the vehicle 100 in response to a control signal from the ECU 104*a*. Further, the door lock control unit 105*a* is configured to detect the state of locking/unlocking the door lock and to be capable of transmitting the detected locking/unlocking information to the device control unit 103 via the ECU 104*a* and the CAN network 110. The navigation system 105*b* is a so-called car navigation system, which is configured to include a GPS receiver, to acquire the position information, etc. of the vehicle 100, and to be capable of transmitting the information to the device control unit 103 via the CAN network 110. The vehicle audio 107 includes a loudspeaker as an in-vehicle audio output unit arranged in the passenger compartment, and is configured to output a predetermined sound (including audio) in response to a control signal from the ECU 104*c*. The vehicle display 108 is a liquid crystal display arranged in the passenger compartment, and is configured as an in-vehicle image display unit which displays a predetermined image (including characters and videos) in response to a control signal from the ECU 104*c*.

Further, the device control unit 103 is configured to access the server 200 via the external network 300 and to be capable of acquiring (download) various information necessary for executing the door lock release control to be described later from the server 200. In addition, the device control unit 103 may be configured to be capable of determining whether the occupant has used the travel guide service before, and may be configured to save the usage history for each occupant on the server 200 by providing (uploading) the individual authentication information obtained from the device 101, etc. to the server 200. Further, the device control unit 103 may be configured to acquire the optimum tourist information, or traffic information, etc. from the server 200 according to an occupant's situation or preference by uploading the occupant's physical information or individual authentication information, etc. obtained from the device 101, etc. to the server 200. The details of the door lock release control performed by the device control unit 103 will be described later.

The server 200 is a cloud server provided on the cloud of the Internet as a computer which provides various information or processing results necessary for executing the travel guide service to the device control unit 103. The server 200 includes a so-called virtual CPU allocated to the server 200 on the cloud and a memory area allocated to the server 200 on the cloud. Various information necessary for executing the door lock release control to be described later is stored in the memory area, and the server 200 is configured to send the information to the device control unit 103 in response to a request from the device control unit 103.

The camera 109 is provided in the vehicle as an imaging means, and is configured to be capable of photographing the behavior of the occupant in particular in the vehicle.

Further, the dotted lines, straight lines, and alternate long and short dash line connecting each of the configurations shown in FIG. 1 are lines indicating wireless or wired information communication means for connecting each of the configurations to enable information communication. The dotted lines indicate connections of wireless LAN and the like, the straight lines indicate wired connections, and the alternate long and short dash line indicates a connection by a communication network such as mobile phone. However, these aspects are one example, and may be appropriately selected as long as the configuration enables necessary information to be transmitted and received at an appropriate speed.

The above is a configuration example of the information processing system 1 to which the information processing apparatus (device control unit 103) of this embodiment is applied. Hereinafter, the door lock release control executed by the device control unit 103 will be described with reference to FIG. 2.

The door lock release control is a control performed to prevent the wearable device 101, which is lent to an occupant who uses the travel guide service in the passenger compartment of the vehicle 100, from being taken out of the passenger compartment. In other words, the door lock release control is a control performed to encourage an occupant to reliably return the wearable device 101 lent to the occupant. Further, as a premise, the user who receives the travel guide service wears the wearable audio device 101 provided in the passenger compartment after getting on the vehicle 100, and must return the wearable audio device 101 to a predetermined position in the vehicle 100 when getting off.

Figure 2:
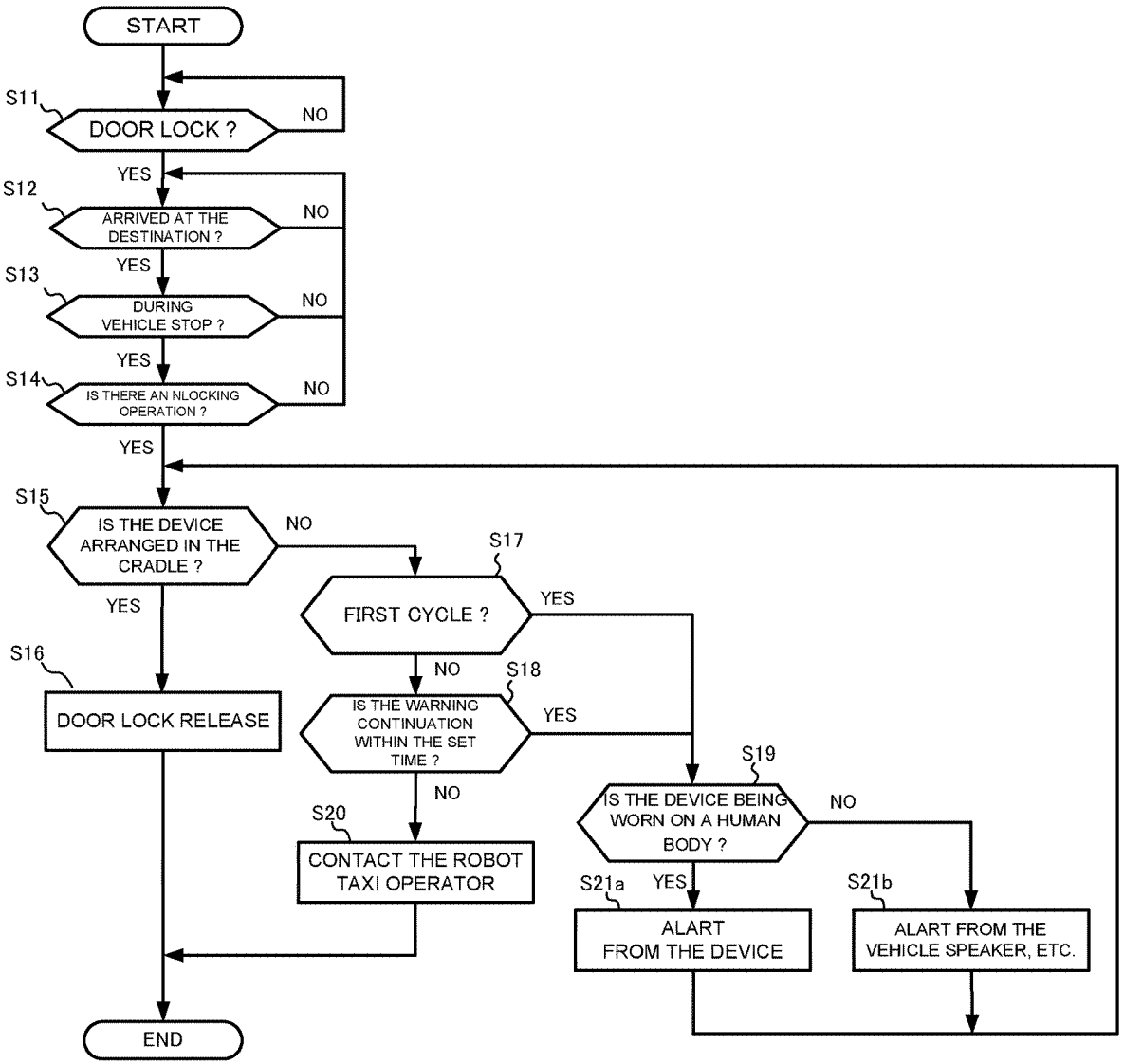
FIG. 2 is a flow chart illustrating a door lock release control according to the first embodiment.

FIG. 2 is a flow chart illustrating the door lock release control according to this embodiment. The device control unit 103 (hereinafter simply referred to as "control unit 103") is programmed so that the processes to be described below with reference to the illustrated flowchart are always executed at predetermined intervals.

In Step S11, the control unit 103 determines whether or not the door lock is locked. The door lock is locked after the user boards the vehicle 100 and before the vehicle 100 departs, or immediately after the vehicle starts running. The door lock is locked by the user who has boarded the vehicle 100, or is automatically locked at a predetermined timing by the door lock control unit 105*a*. Once it is determined that the door lock is locked, it is determined that the user's boarding into the vehicle 100 is completed and the travel guide service for the user (occupant) is started, and the process of the subsequent Step S12 is executed. Once it is determined that the door lock is not locked, it is determined that the user's boarding into the vehicle 100 is still not completed and the travel guide service for the occupant has not started yet, and the process of Step S11 is repeated until the door lock is locked.

In Step S12, the control unit 103 determines whether or not the vehicle 100 has arrived at the destination. Whether or not the vehicle 100 has arrived at the destination may be determined based on the position information of the vehicle 100 obtained from the navigation system 105*b*. Further, the destination should be preset before the travel guide service is started. Once it is determined that the vehicle 100 has arrived at the destination, the process of the subsequent Step S13 is executed to determine whether or not the vehicle has stopped. When it is determined that the vehicle 100 has not arrived at the destination, the process of Step S12 is repeated until the vehicle 100 arrives at the destination. Further, it may be determined that the vehicle has stopped by detecting the state in which the ignition switch of the vehicle is turned off.

In Step S13, the control unit 103 determines whether or not the vehicle 100 has stopped. Whether or not the vehicle has stopped may be determined according to the vehicle speed or the state of the parking brake, etc. For example, when the vehicle speed is 0 or the parking brake is activated, it is determined that the vehicle has stopped. When it is determined that the vehicle has stopped, the process of the subsequent Step S14 is executed to determine the getting-off intention of the occupant, that is, whether or not the occupant gets off. When it is determined that the vehicle has not stopped, considering the possibility that the destination of the vehicle 100 has been changed, the processes from Step S12 to Step S13 are repeated until it is determined that the vehicle has stopped.

In Step S14, the control unit 103 determines whether or not the occupant gets off the vehicle 100. When, for example, the following motion (getting-off-motion) is detected, the control unit 103 determines that the occupant gets off. That is, when it is detected that there is a motion of attempting to unlock the door lock of the vehicle 100 from inside the passenger compartment, a motion of attempting to open the door of the vehicle 100, a motion of the occupant removing the seat belt, a motion of the occupant standing up in the passenger compartment, etc., the control unit 103 determines that the occupant gets off, or more strictly speaking, the occupant is about to get off. Further, it may be determined that the occupant gets off when it is detected that a vehicle use termination operation (service stop operation), which is an operation to be performed when the occupant wants to stop the travel guide service and get off the vehicle 100, has been performed via a predetermined input means (for example, a touch panel) provided in the vehicle 100 or a mobile terminal, etc. owned by the occupant. A known method may be used as a method for detecting such a getting-off-motion, and the method is not particularly limited. For example, the unlocking of the door lock may be determined by detecting that the switch for unlocking the door lock provided in the passenger compartment has been operated. Further, the motion of removing the seat belt may be determined by detecting that the tongue of the seat belt has been removed from the buckle. Further, the motion of the occupant standing up may be determined based on the change in weight detected by a weight sensor provided in the seat. Further, if the camera 109 is provided in the passenger compartment, the control unit 103 may be configured to determine that the occupant gets off the vehicle 100 when it is detected that there is a motion (getting-off-motion) that the occupant is about to get off the vehicle 100 based on an image taken by the camera 109.

Further, whether or not the occupant gets off the vehicle 100 may be determined depending on the elapsed time since it is detected that the vehicle has stopped, not on whether or not the aforementioned getting-off-motion has been performed. In this case, the control unit 103 may determine that the occupant gets off the vehicle 100 when it detects that a predetermined time (for example, 30 seconds) has elapsed after the vehicle is determined to have stopped in Step S13. Once it is determined that the occupant gets off the vehicle 100, the process of Step S15 is executed to determine the location of the device 101. When it is determined that the occupant is not get off the vehicle 100, the processes from Step S12 to Step S14 are repeated until the occupant is determined to be got off the vehicle 100. Further, when it is detected that the occupant has input an instruction of stopping in the vicinity to a predetermined in-vehicle device, it may be determined that the occupant gets off the vehicle 100. The predetermined in-vehicle device is, for example, a microphone or a switch which receives instructions of getting-off, and when the occupant inputs an audio of getting-off to the microphone or selects the switch which receives instructions of getting-off, the control unit 103 determines that the occupant gets off.

In Step S15, the control unit 103 determines whether or not the wearable audio device 101 has been returned to a predetermined position in the passenger compartment. Here, the predetermined position in this embodiment is the location where the cradle 102 is arranged. Whether or not the device 101 is returned to the position where the cradle 102 is arranged may be determined by detecting whether or not the device 101 is attached to the cradle 102. Whether or not the device 101 is attached to the cradle 102 may be determined by detecting via the contact switch provided on the cradle 102 or by detecting whether or not the cradle 102 and device 101 are electrically connected in order to charge the device 101 (whether or not the device 101 is being charged), etc. By determining whether or not the device 101 is returned based on whether or not it is electrically connected to the cradle 102, it is possible to simultaneously determine whether or not the returned device 101 is charged. Further, when the camera 109 is provided in the passenger compartment, the control unit 103 may be configured to determine whether or not the device 101 has been returned to the predetermined position based on an image taken by the camera 109.

Once it is determined in Step S15 that the device 101 has been returned to the predetermined position, the process of Step S16 is executed to allow the occupant to get off. On the other hand, when it is determined that the device 101 has not been returned to the predetermined position, the process of Step S17 is executed to determine whether or not the present flow related to the door lock release control is the first cycle.

In Step S16, the control unit 103 determines that the device 101 lent to the occupant in the passenger compartment has been properly returned, releases the door lock, and terminates the door lock release control. This allows the occupant to get off the vehicle 100.

In Step S17, the control unit 103 determines whether or not the present flow related to the door lock release control started from Step S11 is the first cycle. More specifically, the control unit 103 determines whether or not the process of Step S17 is executed for the first time in the flow related to the door lock release control that starts after the travel guide service is started. When it is determined that the process of Step S17 is executed for the first time, the process of Step S19 is executed to determine whether or not the device 101 is being worn by the occupant. When it is not the first time that the process of Step S17 is executed, that is, when it is determined that the present flow related to the door lock release control started from Step S11 is at least the second or later cycle that has undergone the process of Step S21*a* or Step S21*b*, the process of Step S18 is executed to determine whether or not the alert (warning) started in Step S21*a* or Step S21*b*, which will be described later, has been continued for a predetermined time or longer.

In Step S19, the control unit 103 determines whether or not the device 101 is being worn by the occupant. Here, the device 101 of this embodiment is configured so that it can be determined whether or not the device 101 is being worn on a human body (ear) by outputting light such as infrared rays from the predetermined position of the device 101 and detecting the reflected light thereof, etc. Therefore, the control unit 103 can acquire information on whether or not the device 101 is being worn on the ear from the device 101 via wireless communication. In addition, Step S19 is a process to be performed when the device 101 is not returned to the predetermined position even though the vehicle 100 arrived at the destination and stopped, and is a process for determining a notifying means for prompting the occupant to return the device 101. When the control unit 103 determines that the device 101 is being worn on the ear, the control unit 103 executes the process of Step S21*a* in order to prompt the occupant to return the device 101 via the device 101. On the other hand, when it is determined that the device 101 is not being worn on the ear, the process of Step S21*b* is executed in order to prompt the occupant to return the device 101 via a notifying means other than the device 101.

In Step S21*a*, the control unit 103 executes a process of prompting the occupant to return the device 101 via the loudspeaker as the sound output unit provided in the device 101. Specifically, the control unit 103 warns the occupant that the device 101 has not yet been returned by outputting at least one of audios and warning sounds (alert) from the device 101. Then, the control unit 103 executes the process of Step S15 for determining whether or not the device 101 has been returned to the predetermined position while continuing the warning.

On the other hand, in Step S21*b*, the control unit 103 executes a process of prompting the occupant to return the device 101 via at least one of the vehicle audio 107 and the vehicle display 108. Specifically, the control unit 103 warns the occupant that the device 101 has not yet been returned by outputting at least one of audios and warning sounds (alert) from the vehicle audio 107, or by displaying an image on the vehicle display 108. Alternatively, the control unit 103 may warn via a mobile terminal owned by the occupant as long as it grasps the number, etc. of the mobile terminal. Then, the control unit 103 executes the process of Step S15 for determining whether or not the device 101 has been returned to the predetermined position while continuing the warning.

Further, the content notified to the occupant via sound or image in Step S21*a* or Step S21*b* is not particularly limited as long as it prompts the occupant to return the device 101 to the predetermined position. For example, it may be an audio or an image including the content "please return the device 101". In addition, an audio or an image including the content "please charge the device 101" may be used to prompt return and charge at the same time.

When it is determined in Step S15 executed through Step S21*a* or Step S21*b* that the device 101 has not yet been returned, the process of Step S17 is executed again. In this case, since the present flow related to the door lock release control started from Step S11 is not the first cycle, the process of Step S18 is executed after the NO determination of Step S17.

In Step S18, it is determined whether or not the warning notified in Step S21*a* or Step S21*b* in the first cycle has continued for a predetermined time or longer. When it is determined that the duration of the warning has not continued for the predetermined time (for example, 1 minute) or longer, the processes of Step S19 and thereafter are repeated until either the device 101 is returned to the predetermined position or it is determined that the warning has continued for the predetermined time or longer. Thus, the warning continues until the lent device 101 is returned to the predetermined position, and the door lock of the vehicle 100 is not unlocked, and therefore, the occupant can reliably return the lent device 101 to the predetermined position without forgetting. Also, even if the occupant intends to steal the device 101, since the door lock is not unlocked until the device 101 is returned to the predetermined position, the theft of the device 101 can be abandoned.

On the other hand, in Step S18, when it is determined that the duration of the warning has continued for the predetermined time or longer, the control unit 103 determines that some trouble has occurred in the passenger compartment, and executes the process of Step S20 in order to notify an external operator of that issue. Further, the external operator is assumed to be, for example, an operator, etc. belonging to a management center, etc. managed by an entity which provides the travel guide service. The external operator is not particularly limited as long as it is a person who can deal with troubles that occur when providing the travel guide service.

In Step S20, the control unit 103 notifies the external operator via a mobile phone communication network, etc. that some trouble has occurred in the passenger compartment, and terminates the door lock release control. Further, it is preferable to configure the vehicle 100 so that the external operator who has been contacted and the occupant can interact with each other using any of the vehicle audio, the vehicle display, or, for example, an unillustrated handset provided in the vehicle 100, etc. Further, it is preferable that the vehicle 100 is configured so that the external operator can control the unlocking of the door lock, etc. by remote control via the mobile phone communication network, etc. Thus, when it is found that the warning continues even though the user has no fault, for example, when the device 101 or the cradle 102 is out of order, the external operator can stop the warning and unlock the door lock to release the occupant.

The above is the details of the configuration of the information processing system 1 of the first embodiment and the door lock release control executed in the information processing system 1. As described above, the information processing apparatus (device control unit 103) of this embodiment includes: a function unit (getting-off determining unit) that determines whether or not the occupant gets off the vehicle 100; a function unit (location determining unit) that determines whether or not the device 101 to be used by the occupant in the vehicle is at the predetermined position in the vehicle 100; a function unit (notification control unit) that controls the device 101, etc. so as to give a predetermined notification to the occupant when it is determined that the occupant gets off and the device 101 is not at the predetermined position; a function unit (wearing state determining unit) that determines whether or not the device 101 is being worn by the occupant; and a function unit (door lock control unit) that controls the locking and unlocking of the door lock of the vehicle 100. However, the above-mentioned contents are an example, and the configuration of the information processing system 1 and the flow of the door lock release control are not necessarily limited to the above-mentioned contents.

For example, the wearable audio device 101 is not necessarily limited to the one described above. Instead of the wearable audio device 101 to be worn on the user's ear, other wearable devices such as a watch type or a glasses type may be adopted. In this case, the method of notifying the occupant of the warning in Step S21*a* described above may be appropriately selected according to the function of the wearable device. For example, if a watch-type or glasses-type wearable device includes an image display unit, a predetermined notification may be given to the occupant via an image displayed on the image display unit. In addition, the device lent to the occupant in the passenger compartment does not necessarily have to be a wearable device in the first place, and other electronic devices such as PDA may be adopted if it is possible to transmit the predetermined information to the user by audio or image.

Also, the predetermined position where the device 101 is to be returned does not necessarily have to match the arrangement position of the cradle 102. The predetermined position where the device 101 is to be returned may be any location designated as a return location in the passenger compartment, and is not particularly limited. On the other hand, it is preferable that a charging device is provided at the predetermined position where the device 101 is to be returned because the device 101 can be charged at the time of return. However, the charging device is not limited to the cradle 102 described above, and other charging devices such as a non-contact power feeding device may be adopted.

Further, the configuration corresponding to the information processing apparatus of this embodiment does not necessarily have to be the device control unit 103. For example, the above-mentioned door lock release control flow may be configured so that the device control unit 103 does not necessarily have to execute all the processes and may share the processes with, for example, the server 200 to execute the processes, as described above. Further, the server 200 may be configured to execute all the processes. In this case, the server 200 has a configuration corresponding to the information processing apparatus of this embodiment. Further, the server 200 does not necessarily have to be provided on the cloud and may be arranged at a predetermined location as a device including a central processing unit (CPU), a read-only memory (ROM), etc., as described above.

Further, the door lock release control flow described with reference to FIG. 2 does not necessarily have to execute all the processes shown in FIG. 2, and may be changed as appropriate. For example, the stop determination according to Step S13 may be omitted. In addition, in the event of an unexpected situation such as an accident, the aforementioned flow may be changed appropriately in order to prioritize the safety of the occupants, such as performing the process of unlocking the door lock regardless of the aforementioned flow. Further, for example, when it is detected that the device 101 has moved to a location separated from the vehicle 100 by a predetermined distance on the basis of the movement information or etc. of the wearable audio device 101, the control unit 103 may warn the occupant via the device 101 to prompt the return of the device 101 and notify the external operator that the device 101 has been taken out of the passenger compartment. As described above, the aforementioned door lock release control flow may be appropriately changed as long as the occupant can be prompted to return the device 101.

Further, the travel guide service described above is an example as a service to be provided by the information processing system 1 of this embodiment, and the service to be provided is not necessarily intended to be limited to such a service. The information processing system 1 can be appropriately applied to any service using a vehicle and any electronic device available to a user in a passenger compartment.

As described above, the information processing apparatus (control unit 103) of the first embodiment includes: a getting-off determining unit (103) that determines whether or not the occupant gets off the vehicle; a location determining unit (103) that determines whether or not the electronic device to be used by the occupant in the vehicle is at the predetermined position in the vehicle; and a notification control unit (103) that gives a predetermined notification to the occupant when the getting-off determining unit determines that the occupant gets off and the location determining unit determines that the electronic device is not at the predetermined position. Thus, since it is possible to notify the occupant of the prompt to return the device 101, etc. when the occupant is about to get off without returning the device 101, it is possible to prevent the electronic device lent to the occupant in a passenger compartment such as a robot taxi from being lost due to forgetting to return or being stolen.

Further, according to the information processing apparatus (control unit 103) of the first embodiment, the getting-off determining unit (103) determines that the occupant gets off the vehicle 100 when it detects that the door lock of the vehicle 100 has been unlocked or the door of the vehicle 100 has been opened. This makes it possible to detect the motion that the occupant is about to get off without the need to further provide a special device for detecting the getting-off-motion of the occupant.

Further, according to the information processing apparatus (control unit 103) of the first embodiment, the getting-off determining unit (103) determines that the occupant gets off the vehicle 100 when it detects that the seat belt used by the occupant has been removed, when the vehicle 100 arrives at the destination, when the occupant instructs to stop the vehicle, or when the vehicle 100 stops. Such a method also makes it possible to detect the motion that the occupant is about to get off without the need to further provide a special device for detecting the getting-off-motion of the occupant.

Further, according to the information processing apparatus (control unit 103) of the first embodiment, the vehicle 100 includes the camera 109 that photographs the inside of the passenger compartment, and the getting-off determining unit (103) determines that the occupant gets off the vehicle when it detects a motion that the occupant is about to get off the vehicle 100 based on an image taken by the camera 109. Thus, the motion that the occupant is about to get off can be detected from various behavioral modes.

Further, according to the information processing apparatus (control unit 103) of the first embodiment, the predetermined notification is given via a sound or an image prompting the occupant to return the electronic device to the predetermined position. This makes it possible to efficiently prompt the occupant to return the device 101.

Further, according to the information processing apparatus (control unit 103) of the first embodiment, the device 101 includes at least one of an image display unit that displays image and a sound output unit that outputs sound, and the notification control unit (103) gives the predetermined notification to the occupant via at least one of the image display unit and the sound output unit provided in the device 101. This makes it possible to prompt the occupant to return the device 101 using the device 101.

Further, according to the information processing apparatus (control unit 103) of the first embodiment, the vehicle 100 includes at least one of an in-vehicle image display unit (108) that displays image and an in-vehicle sound output unit (107) that outputs sound, and the notification control unit (103) gives the predetermined notification to the occupant via at least one of the in-vehicle image display unit (108) and the in-vehicle sound output unit (107). This makes it possible to prompt the occupant to return the device 101 using the notification control unit (103) or the in-vehicle image display unit (108) provided in the vehicle 100.

Further, according to the information processing apparatus (control unit 103) of the first embodiment, the notification control unit (103) gives the predetermined notification to the occupant via a mobile terminal owned by the occupant. This makes it possible to prompt the occupant to return the device 101 using a mobile terminal such as a smart phone owned by the occupant.

Further, according to the information processing apparatus (control unit 103) of the first embodiment, the device 101 is a wearable device worn on the body of the occupant. Thus, since it is possible to directly appeal to the auditory sense or the visual sense, etc. of the occupant wearing the device 101 when prompting the occupant to return the device 101 via the device 101, it is possible to reduce the possibility that the notified content does not reach the occupant.

Further, according to the information processing apparatus (control unit 103) of the first embodiment, the apparatus further includes a wearing state determining unit (103) for determining whether or not the wearable device 101 is being worn by the occupant, the vehicle 100 includes at least one of the in-vehicle image display unit (108) that displays image and the in-vehicle sound output unit (107) that outputs sound, and the notification control unit (103) gives the predetermined notification to the occupant via the wearable device 101 when it is determined that the wearable device 101 is being worn by the occupant, and gives the predetermined notification to the occupant via at least one of the in-vehicle image display unit (108), the in-vehicle sound output unit (107), and a mobile terminal owned by the occupant when it is determined that the wearable device 101 is not being worn by the occupant. This makes it possible to select an appropriate notifying means depending on whether or not the occupant is wearing the device 101.

Further, according to the information processing apparatus (control unit 103) of the first embodiment, the apparatus further includes a door lock control unit (103) that controls the locking and unlocking of the door lock of the vehicle 100, and the door lock control unit (103) unlocks the door lock when the getting-off determining unit (103) determines that the occupant gets off and the location determining unit (103) determines that the electronic device 101 has been returned to the predetermined position. Thus, since the door lock will not be unlocked unless the occupant returns the device (101) to the predetermined position, the risk of the occupant taking the device (101) out of the passenger compartment can be more reliably suppressed.

Further, according to the information processing apparatus (control unit 103) of the first embodiment, the vehicle includes a charging device (102) that charges the electronic device 101, and the location determining unit (103) determines that the electronic device has been returned to the predetermined position in the vehicle when it detects that the electronic device and the charging device are electrically connected. Thus, since it is possible to determine whether or not the device (101) has been returned and to determine whether or not the device (101) is charged, it is possible to prevent the device (101) from being out of charge and unable to perform the predetermined service.

Second Embodiment

Hereinafter, the individual authentication and device management control executed by the information processing apparatus (control unit 103) of the second embodiment will be described. The individual authentication and device management control executed in this embodiment are the controls executed in place of the door lock release control executed by the control unit 103 in the first embodiment. Hereinafter, the details of the individual authentication and device management control executed in the second embodiment will be described with reference to FIG. 3.

Figure 3:
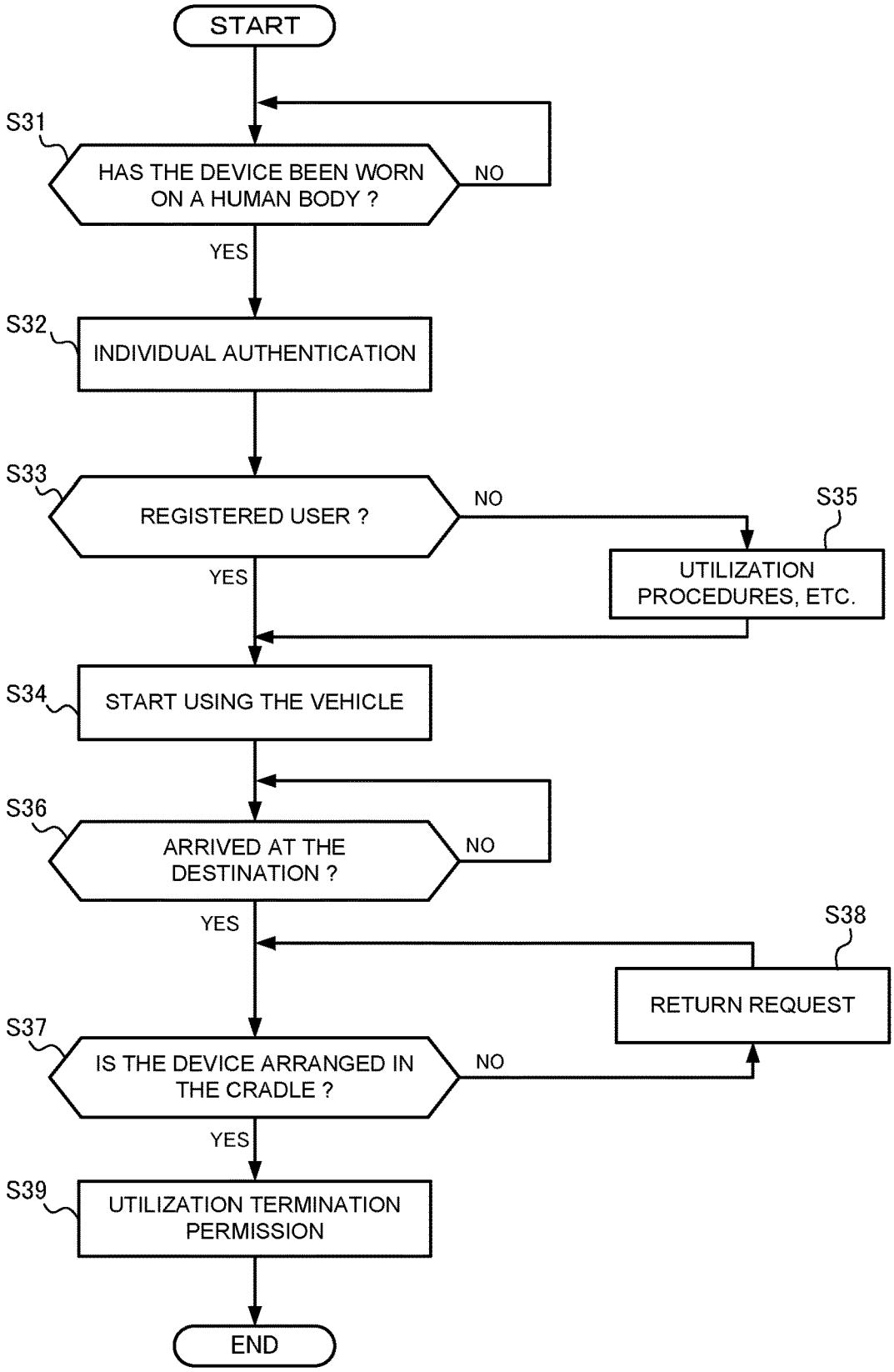
FIG. 3 is a flow chart illustrating an individual authentication and a device return management control according to a second embodiment.

FIG. 3 is a flow chart illustrating the individual authentication and device management control executed in the second embodiment. The control unit 103 of this embodiment is programmed so that the processes described below with reference to the illustrated flow chart are constantly executed at predetermined intervals.

In Step S31, the control unit 103 determines whether or not the device 101 has been worn by the occupant after the user gets on the vehicle 100. When it is determined that the device 101 has been worn by the occupant, the process of the subsequent Step S32 is executed to perform the individual authentication using the device 101. When it is determined that the device 101 has not been worn by the occupant, the process of Step S31 is repeated until the device 101 is worn by the occupant.

In Step S32, the control unit 103 causes the device 101 to execute the individual authentication by otoacoustic authentication, etc., and acquires the individual authentication information acquired by the device 101 via wireless LAN and the like. Once the individual authentication information is acquired, the control unit 103 executes the process of the subsequent Step S33 to determine whether or not the acquired individual authentication information is about a user who has already been registered.

In Step S33, the control unit 103 determines whether or not the individual authentication information acquired in Step S32 is the information of an already registered user. Specifically, first, the control unit 103 transmits, for example, the acquired individual authentication information to the server 200 via an external network. The server 200 determines whether or not the transmitted individual authentication matches an already registered individual authentication by comparing the received individual authentication information with the registered users' individual authentication information stored in the memory area of the server 200, and transmits the determination result to the control unit 103. When the control unit 103 obtains the determination result that the subject of the individual authentication information acquired in Step S32 is a registered user, the process of the subsequent Step S34 is executed. Further, it is preferable that the registered user has not only registered the address and name, etc., but also personal information regarding the user language, hobbies and tastes. By registering such personal information, it is possible to provide a better service individually adapted to the user's hobbies and tastes, etc.

On the other hand, when it is determined that the subject of the individual authentication information acquired in Step S32 is not a registered user, it is determined that the user is a first-time user of the travel guide service, and the process of Step S35 is executed in order to perform the registration procedure. Further, the registration procedure may be performed using a predetermined electronic device (for example, a touch panel display) provided in the vehicle 100, and may be performed using a mobile terminal owned by the user (for example, a smart phone). Further, it is preferable that the registration procedure is executed based on the individual authentication information acquired by otoacoustic authentication, etc. in Step S32. Thereby, the individual authentication and inquiring process as to whether or not the user is registered can be completed relatively smoothly without requiring complicated input work the next time the user wears the wearable audio device 101 when using the service. When the registration procedure is completed, the process of Step S34 is executed.

In Step S34, the control unit 103 starts the travel guide service using the vehicle 100. Further, the travel guide service in this embodiment is executed based on the individual authentication information acquired in Step S32. Therefore, if the occupant is already a registered user, the control unit 103 can provide more accurate travel guide that suits the user's preference based on the registered personal information. In addition, since the device 101 lent to the occupant in this embodiment is linked to the personal information of the occupant by the processes of Step S32 to Step S34, even if the device 101 is taken out of the vehicle, the personal information of the user who has taken out the device 101 can be identified. Thus, regarding the travel guide service in this embodiment, the quality of service to users can be improved and more effective risk management can be realized against theft, etc. of the device 101 by making it mandatory to acquire the user's individual authentication information.

In Step S36, the control unit 103 determines whether or not the vehicle 100 has arrived at the destination. Once it is determined that the vehicle 100 has arrived at the destination, the process of Step S37 is executed to determine whether or not the device 101 has been returned to the predetermined position.

In Step S37, the control unit 103 determines whether or not the device 101 has been returned to the predetermined position in the passenger compartment. The predetermined position in this embodiment is the location where the cradle 102 is arranged as in the first embodiment. Once it is determined that the device 101 has been returned to the predetermined position, the process of Step S39 is executed in order to terminate the travel guide service. On the other hand, when it is determined that the device 101 has not been returned to the predetermined position, the process of Step S38 is executed in order to prompt the occupant to return the device 101.

In Step S38, the control unit 103 executes a process for prompting the occupant to return the device 101. Specifically, the control unit 103 executes the same processes as Step S19, Step S21*a*, and Step S21*b* according to the flow chart shown in FIG. 2. That is, the control unit 103 first determines whether or not the device 101 is being worn on a human body (see Step S19). When it is determined that the device 101 is being worn on a human body, the control unit 103 executes the process of prompting the occupant to return the device 101 via the loudspeaker provided in the device 101 (see Step S21*a*). On the other hand, when it is determined that the device 101 is not being worn on a human body, the control unit 103 executes the process of prompting the occupant to return the device 101 via at least one of the vehicle audio 107 and the vehicle display 108 (see Step S21*a*). Further, in this embodiment, when the user's personal information (telephone number of the mobile terminal owned by the user) is known and it is determined that the device 101 is not being worn on a human body, the control unit 103 may prompt the occupant to return the device 101 via the mobile terminal owned by the occupant.

Further, in this embodiment, the content to be notified to the occupant when prompting the return of the device 101 can be changed according to the personal information of the occupant. For example, when the control unit 103 can grasp the language used by the occupant from the personal information, it notifies the occupant of the return of the device 101 by audio or characters (image) in that language.

Once a process of giving a predetermined notification for prompting the occupant to return the device 101 is executed, the processes of Step S37 and Step S38 are repeated until the device 101 is returned to the predetermined position.

Then, in Step S39, the control unit 103 terminates the travel guide service. In this way, by executing the above service after performing individual authentication of the user, the quality of service and risk management can be improved, and the occupant can be prompted to return the device 101 in a language that the occupant can reliably understand.

The above is the details of the individual authentication and device management control of the second embodiment. As described above, the information processing apparatus (device control unit 103) of this embodiment further includes a function unit (personal information acquisition unit) for acquiring the personal information of the occupant in addition to the first embodiment. However, the above-mentioned contents are an example, and similar to what is described in the first embodiment, the configuration of the information processing system 1 and the flow of individual authentication and device management control are not necessarily limited to the above-mentioned contents and may be changed as appropriate.

According to the information processing apparatus (control unit 103) of the second embodiment above, the apparatus further includes a personal information acquisition unit (103) that acquires the personal information of the occupant, and the notification control unit (103) changes the content of the predetermined notification according to the acquired personal information. Thus, since the above service can be executed after grasping the individual authentication of the user, the quality of service and risk management can be improved. In addition, by acquiring information on the language used by the occupant as personal information, it is possible to reliably prompt the occupant to return the device 101 in a language that the occupant can reliably understand.

While the embodiments of the present invention have been described above, the above-described embodiments only show part of application examples of the present invention and are not intended to limit the technical scope of the present invention to the specific configurations of the above-described embodiments. Further, the above-mentioned first and second embodiments can be appropriately combined as long as there is no contradiction.

The invention claimed is:

1. An information processing apparatus, comprising:

a getting-off determining unit that determines whether or not an occupant gets off a vehicle;

a location determining unit configured to determine whether or not an electronic device to be used by the occupant in the vehicle is at a predetermined position in the vehicle; and a door lock control unit configured to control locking and unlocking of a door lock of the vehicle, wherein:

the door lock control unit is configured to unlock the door lock when the getting-off determining unit determines that the occupant gets off and the location determining unit determines that the electronic device has been returned to the predetermined position, wherein the vehicle includes a charging device that charges the electronic device; and wherein the location determining unit is configured to determine that the electronic device has been returned to the predetermined position in the vehicle when the location determining unit detects that the electronic device and the charging device are electrically connected.

2. The information processing apparatus according to claim 1, wherein:

the getting-off determining unit is configured to determine that the occupant gets off the vehicle when it detects that a seat belt used by the occupant has been removed, when the vehicle arrives at a destination, when the occupant instructs to stop the vehicle, or when the vehicle stops.

3. The information processing apparatus according to claim 1, wherein:

the vehicle includes a camera that photographs an inside of a passenger compartment; and the getting-off determining unit is configured to determine that the occupant gets off the vehicle when it detects a motion that the occupant is about to get off the vehicle based on an image taken by the camera.

4. The information processing apparatus according to claim 1, further comprising:

a notification control unit configured to give a predetermined notification to the occupant when the getting-off determining unit determines that the occupant gets off and the location determining unit determines that the electronic device is not at the predetermined position.

5. The information processing apparatus according to claim 4, wherein:

the predetermined notification is given via a sound or an image prompting the occupant to return the electronic device to the predetermined position.

6. The information processing apparatus according to claim 4, wherein:

the electronic device includes at least one of an image display unit that displays image and a sound output unit that outputs sound; and the notification control unit is configured to give the predetermined notification to the occupant via at least one of the image display unit and the sound output unit provided in the electronic device.

7. The information processing apparatus according to claim 4, wherein:

the vehicle includes at least one of an in-vehicle image display unit that displays image and an in-vehicle sound output unit that outputs sound; and the notification control unit is configured to give the predetermined notification to the occupant via at least one of the in-vehicle image display unit and the in-vehicle sound output unit.

8. The information processing apparatus according to claim 4, wherein:

the notification control unit is configured to give the predetermined notification to the occupant via a mobile terminal owned by the occupant.

9. The information processing apparatus according to claim 4, wherein:

the electronic device is a wearable device worn on a body of the occupant, or a mobile device.

10. The information processing apparatus according to claim 9, further comprising:

a wearing state determining unit configured to determine whether or not the wearable device is being worn by the occupant, wherein:

the vehicle includes at least one of an in-vehicle image display unit that displays image and an in-vehicle sound output unit that outputs sound; and the notification control unit is configured to give the predetermined notification to the occupant via the wearable device when it is determined that the wearable device is being worn by the occupant and to give the predetermined notification to the occupant via at least one of the in-vehicle image display unit, the in-vehicle sound output unit, and a mobile terminal owned by the occupant when it is determined that the wearable device is not being worn by the occupant.

11. The information processing apparatus according to claim 4, further comprising:

a personal information acquisition unit configured to acquire personal information of the occupant, wherein:

the notification control unit is configured to change a content of the predetermined notification according to the acquired personal information.

12. An information processing method, the method is configured comprising:

determining whether or not an occupant gets off a vehicle;

determining whether or not an electronic device to be used by the occupant in the vehicle is at a predetermined position in the vehicle;

controlling locking and unlocking of a door lock of the vehicle;

unlocking the door lock when it is determined that the occupant gets off and the electronic device has been returned to the predetermined position;

charging the electronic device via a charging device; and determining, via a location determining unit, that the electronic device has been returned to the predetermined position in the vehicle when the location determining unit detects that the electronic device and the charging device are electrically connected.

* * * * *